US009504868B2

(12) United States Patent
Liu

(10) Patent No.: US 9,504,868 B2
(45) Date of Patent: Nov. 29, 2016

(54) DUMBBELL GLIDE APPARATUS WITH WEIGHT ADJUSTING KEY

(76) Inventor: Ping Liu, Shanxi (CN)

( * ) Notice: Subject to any disclaimer, the term of this patent is extended or adjusted under 35 U.S.C. 154(b) by 348 days.

(21) Appl. No.: 13/151,261

(22) Filed: Jun. 1, 2011

(65) Prior Publication Data

US 2012/0309597 A1 Dec. 6, 2012

(51) Int. Cl.
*A63B 21/072* (2006.01)
*A63B 21/075* (2006.01)

(52) U.S. Cl.
CPC ..... *A63B 21/0726* (2013.01)

(58) Field of Classification Search
USPC ..... 482/50, 104–108, 98, 99, 49
See application file for complete search history.

(56) References Cited

U.S. PATENT DOCUMENTS

| | | | | |
|---|---|---|---|---|
| 6,416,446 | B1 * | 7/2002 | Krull | 482/108 |
| 6,656,093 | B2 * | 12/2003 | Chen | 482/108 |
| 7,090,625 | B2 * | 8/2006 | Chermack | 482/108 |
| 7,621,855 | B1 * | 11/2009 | Krull | 482/107 |

* cited by examiner

*Primary Examiner* — Loan H Thanh
*Assistant Examiner* — Nyca T Nguyen
(74) *Attorney, Agent, or Firm* — Kenneth Bower

(57) ABSTRACT

A dumbbell apparatus which is adapted with a series of weight plates, the number of which can be safely and reliably adjusted with a single simple motion. The apparatus comprises a cradle for storing and deploying the apparatus, weight plates, and a handle apparatus which has two spline bolts which support the weight plates and are used to simultaneously be adjusted by means of an adjusting pin which moves the spline members together through a motion transmitting gear. The apparatus may be further enhance with permanent weights and gripping options.

14 Claims, 7 Drawing Sheets

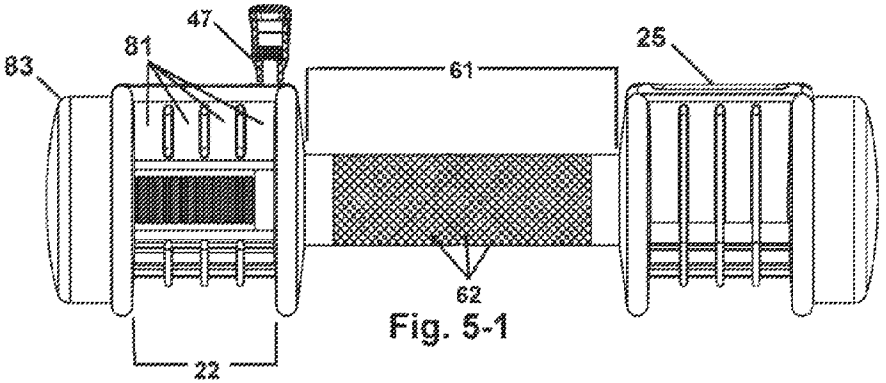
Fig. 5-1
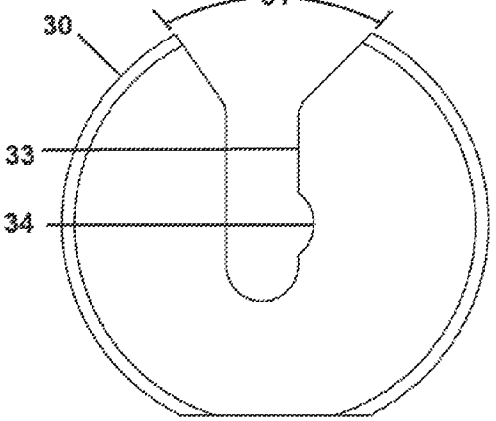
Fig. 5-2
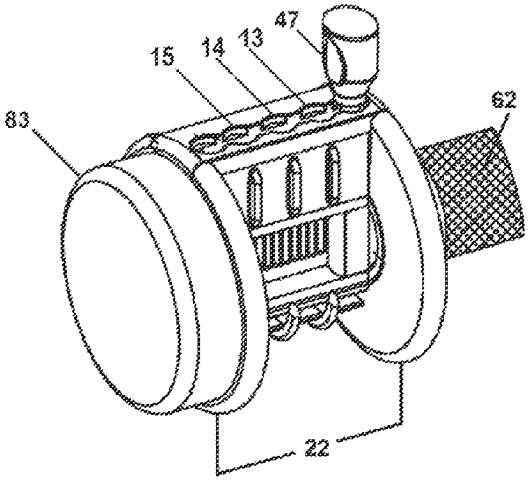
Fig. 5-3
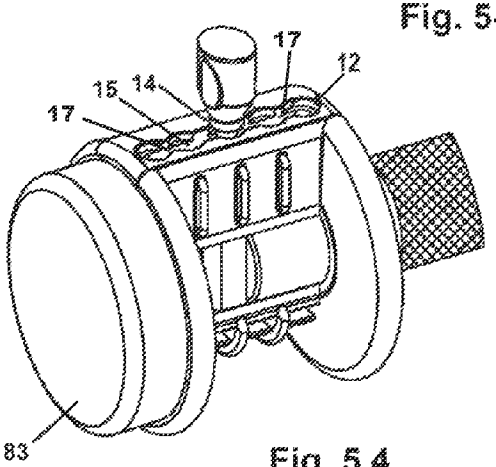
Fig. 5.4

Section "C-C"

Section "B-B"

Section"D-D"

DUMBBELL GLIDE APPARATUS WITH WEIGHT ADJUSTING KEY

FIELD OF THE INVENTION

The invention relates to exercise and fitness devices, in particular apparatus for light weightlifting, such as dumbbells, further including those which are adapted for adjustable weights.

BACKGROUND OF THE INVENTION

The dumbbell is a very popular exercise and fitness device. It affords both effective and varied fitness training. Such is normally used for light weight lifting with a single arm although they are also deployed in pairs so that both arms may be exercised simultaneously. As the type of exercises which may be involved with dumbbell workouts are varied, it is helpful to have the ability to quickly switch from one weight to another in order to make the most use of the time available for exercise. One way this can be done would be to have a number of dumbbells of varying weights, but this is expensive and creates a storage problem. A means of permitting switching from one weight to another without substantial storage problems is to use weight adjustable dumbbells.

Generally speaking, weight adjustable dumbbells comprise a dumbbell handle which is adapted at both ends to receive one or more weight plates and such may further comprise means of locking and fastening the weight plates into position for safe use. There are many kinds of weight adjustable dumbbells in the market.

For example, reference is made to US200405969A1. This apparatus teaches a device in which it is necessary to set the adjusting mechanism in both ends of the dumbbell handle separately in order that the bolt fixes relative weight plates. It is not convenient and requires additional time to set a certain weight because two separate actions are required.

Reference is also made to US20070184945A, which avoids the above mentioned defects by adopting theory of sinistral and dextral threading. The bolts in the ends of the dumbbell can be moved by dialing the turntable, so that the bolt fixes certain plates of the desired weights. However, because the threading on the thread rod is a continuous line, the weight location is not precise. Precise location of this kind of dumbbell requires adding positioning mechanisms which are complex and expensive.

There are numerous dumbbell variations in the market but none of them allow simultaneous setting of precise and balanced weights. Such would offer a distinct advantage. What is not provided in the prior art is an adjustable weight dumbbell which permits and facilitates rapid and efficient adjustment of the weight plates and also results in a balanced and safe way to change weights with dumbbell apparatus.

SUMMARY OF THE INVENTION

The inventor has overcome the shortcomings of the prior art by providing a weight adjustable dumbbell of simple structure, which is simple to use, safe, and reliable. The inventor has done this by providing a weight adjustable dumbbell which is comprised of a dumbbell handle assembly, a number of pieces of weight plates and a weight plate base. The dumbbell handle assembly is comprised of a handle member, two handle brackets, two spline bolt bodies, a positioning gear, an adjusting key and a positioning plate.

There are adjustable slots and bolt slots in the handle member. A series of adjustable slots are on top of one side of the handle member on one side and bolt slots are on two sides of the handle member. There are slide slots on top of one handle bracket and guide slots on two sides of the handle member. Two handle brackets are fixed on two ends of the handle member respectively.

Two spline bolt bodies are inserted at both ends of the handle member and engage each other by means of the gear within the handle member. A positioning plate is fixed on the sliding slot of one handle bracket in one of several discrete adjustment positions, corresponding to the number of weight plates. An adjustable key may be passed though a narrow slot of the the positioning plate and may be fixed on the threaded hole of the spline bolt body. There is an angled gap in each weight plate and a rectangle slot under the angled gap for holding the handle bar assembly. The angled gap and the elongated and rectangle slot under it make a Y shaped slot. In the elongated and rectangle slot, there is an arc slot for holding the spine bolt body. A number of cradling slots are also opened on the weight plate base.

An axle hole is in the above mentioned handle member. The gear is positioned on the axle though the hole is turns about the axle and is fixed in position by a pin. The gear meshes with teeth on the interior of each spline member. Weight plates are positioned on two ends of the above mentioned handle member ibn this base, which is adapted with cradles for each. A cover board is fixed by a screw on the slide slot of one of the above mentioned handle brackets.

The above mentioned adjustable handle is comprised of an adjusting pin, a retaining spring and a positioning base. The adjusting pin is fixed in the threading hole of an adjusting spine bolt body by the positioning base, retaining spring, locating slot in the positioning plate, slide slot and adjustable slot in the handle bracket. This permits the two spline bodies to be simultaneously and precisely moved in and out with the same movement. There may be a weight indication label on the above mentioned positioning plate. A handle cover is fixed on the above mentioned positioning base.

It is then, an object of the present invention to provide a weight adjustable dumbbell which has an adjusting handle which further allows the user to simply and easily choose an equal amount of weight plates on both ends of the handle bar assembly simultaneously.

It is a further object of the present invention to provide a weight adjustable dumbbell with a weight indication label on the positioning plate which makes weight selection simple and easy.

It is a further object of the present invention to provide a handle and positioning plate of the weight adjustable dumbbell with a self-lock function, so that the spline bolt body will not move randomly. Thus the weight plates are fixed on the handle bar assembly safely, which allows safe and reliable applying and lifting.

It is a further object of the present invention to provide the two spline bolt bodies of the weight adjustable dumbbell which can work together though the gear and conduct physically equivalent elongation or shortening.

It is a further object of the present invention to provide such a dumbbell apparatus which is enhanced for gripping by scoring a gripping surface or by providing an alternative material for the gripping surface in order to provide comfort or safety.

It is a further object of the present invention to provide such an adjustable dumbbell apparatus which may be tailored for use with a variety of weight quantities.

It is a further object of the present invention to provide such a dumbbell apparatus which is amenable to a variety of manufacturing methods.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

FIGS. 4-1 through 4-3 are several cutaway views of the dumbbell bar assembly., including
FIG. 4-1 which is an oblique side cutaway view, FIG. 4-2 which is a front view with the left bracket member being cutaway, and FIG. 4.3 which is a top cutaway view.

FIGS. 5-1 through 5-4 are drawings which depict various key features of the adjustment of the dumbbell bar assembly. These include FIG. 5-1 which is a front view of the dumbbell bar assembly with the left bracket member cut out and which shows the adjustment pen and a first position. FIG. 5-2 depicts a view of the weight plate which demonstrates how it is received by the spline members, FIG. 5-3 depicts the adjusting key in a first position and FIG. 5-4 depicts the adjustment pin in a second position.

FIGS. 6-1 through 6-3 depicts various views of the apparatus including FIG. 6-1, the front view in which a single weight plate is selected, 6-2 which is the left side cross-section view while choosing one piece of weight plate and FIG. 6-3 the top cross-section view while choosing one piece of weight plate.

FIGS. 7-1 through 7-3 is the schematic drawing of the work theory of the utility model. Including FIG. 7-1, which is the front view while choosing four pieces of weight plates, FIG. 7-2 the left side cross-section view while choosing four pieces of weight plates, and FIG. 7-3 which is the front cross-section view while choosing four pieces of weight plates, While certain drawings have been provided in order to teach the principles and operation of the present invention, it should be understood that, in the detailed description which follows, reference may be made to components or apparatus which are not included in the drawings. Such components and apparatus should be considered as part of the description, even if not included in such a drawing. Likewise, the drawings may include an element, structure, or mechanism which is not described in the textual description of the invention which follows. The invention and description should also be understood to include such a mechanism, component, or element which is depicted in the drawing but not specifically described.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

While the following description will seek to improve understanding of the invention by describing the various components and elements, it should be considered that certain apparatus may be sufficiently and adequately explained by the accompanying drawings, which are fully incorporated herein, and not require further description. All such apparatus should be considered as part of the specification of the invention for all purposes.

Figure 1:
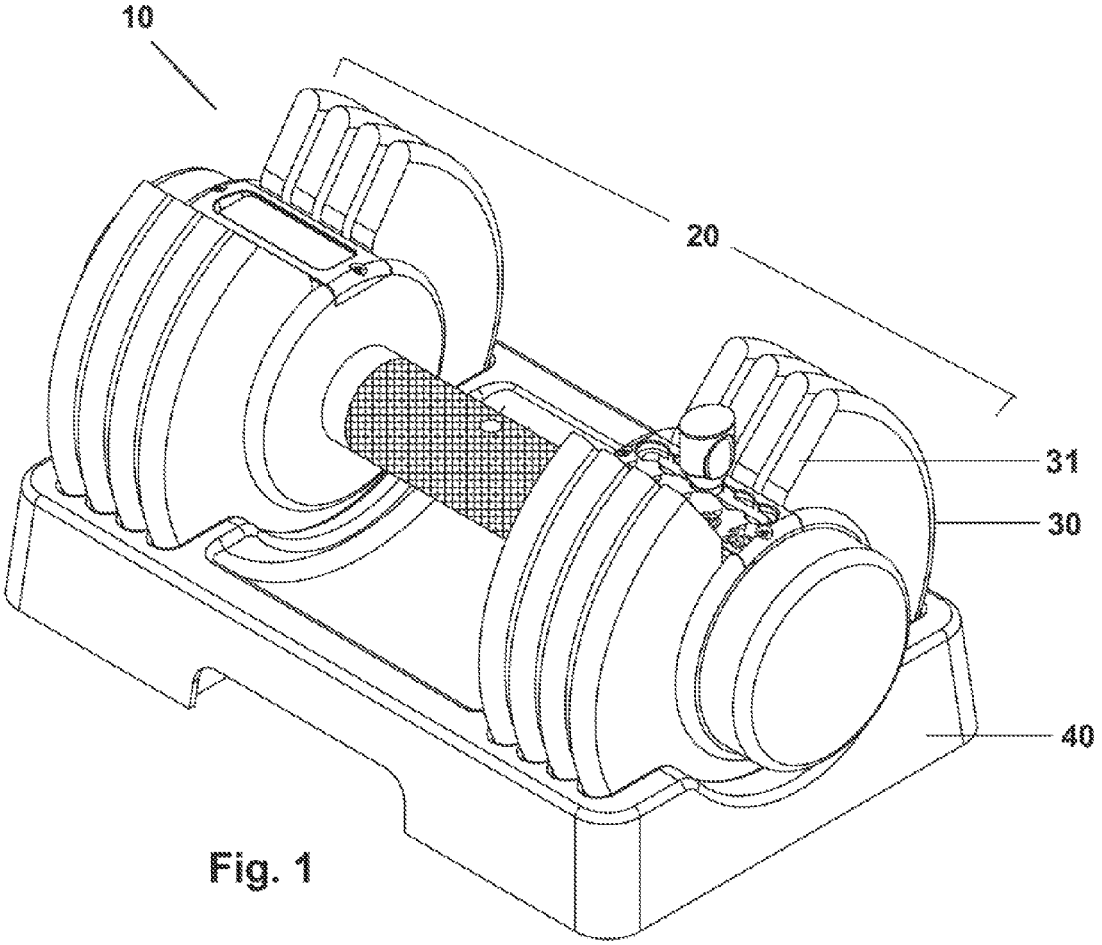
FIG. 1 is an oblique view of the apparatus as it is assembled for use.
Figure 2:
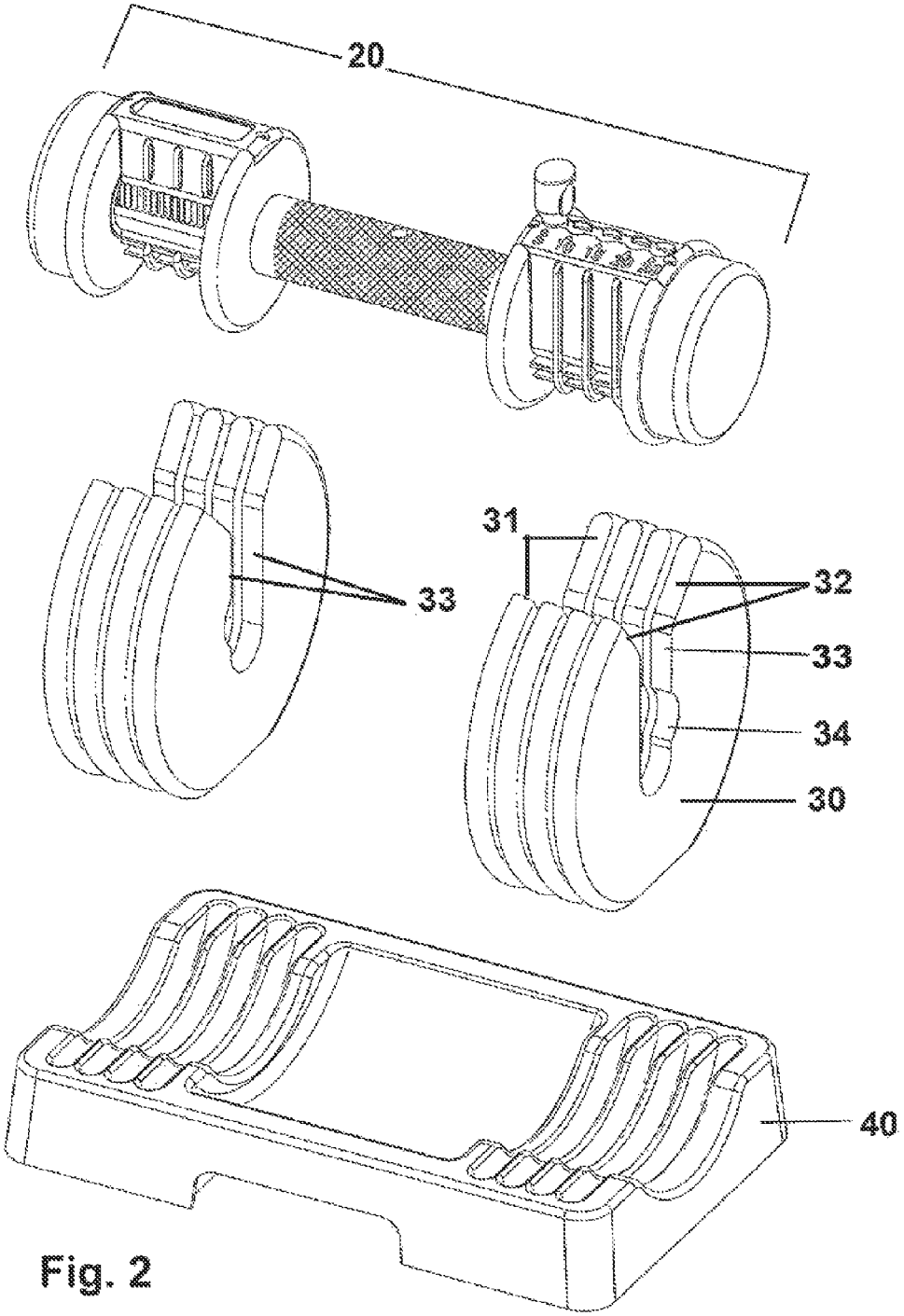
FIG. 2 depicts the apparatus with the major components separated in relative position so that all major components may be seen.

First referring to FIG. 1 and FIG. 2, it can be seen that the weight adjustable dumbbell according to the preferred embodiment of the present invention is comprised of dumbbell bar assembly (20), weight plates (30) and base member (40) as its major components. FIG. 1 depicts the apparatus in its standard condition while FIG. 2 depicts the major components apart from one another so that their critical features may be seen. Dumbbell bar assembly (20) houses the critical moving parts of the invention and of the weight adjusting function. The cradle apparatus (40) provides means for both storage and deployment of the entire apparatus.

Each weight plate (30) has a Y shaped slot (31) which is comprised of upper angled gap (32), elongated and rectangular slot (33) and an arc slot (34). The arc slot (34) is to allow the weight plate (30) two be received by the dumbbell bar assembly (20) and be held into place as will be more fully described herein. The elongated and rectangular slot (33) is to hold the dumbbell bar assembly (20), the angle gap (32) is to guide the dumbbell bar assembly (20) to drop into the elongated and rectangular slot (33). Base member (40) is to hold and position the weight plates (30). The amount of slots (41) is the same as the amount of weight plates (30). The base member (40) is also for the support of the dumbbell bar assembly (20).

Figure 3:
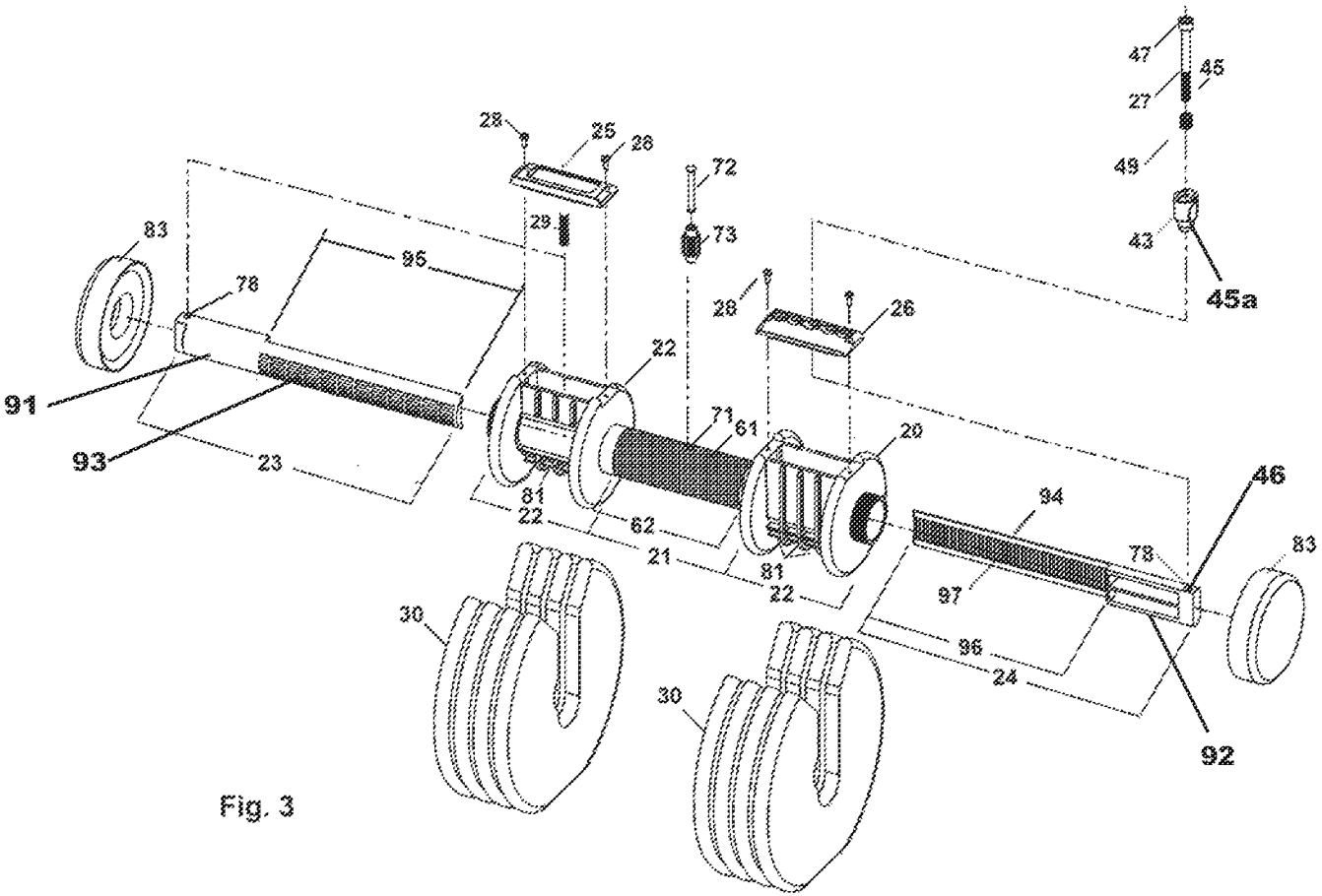
FIG. 3 depicts the entire apparatus with each piece separated and in relative position.

Referring now to FIG. 3, the dumbbell bar assembly (20) is comprised primarily of handle member (21), handle brackets (22), adjusted spline bolt body (23), adjusting spline bolt body (24), positioning gear (73), positioning plate (26), adjusting pin (29), cover plate (25) and weight body (30). Handle brackets (22) are attached to both ends of the handle member (21). By providing a scored surface (61) on the grip portion (62) in the middle of the handle member (21) the grip portion (62) may be adapted to facilitate a more secure grip by the user. On the handle member (21) opposite from the positioning plate (26) is a cover plate (25). The handle bracket (22) are also adapted with guiding slots (81) which are useful in keeping the weight plates (30) aligned. Finally, the handle brackets may be further adapted with equal weights (83) on either end which would be permanent to provide stability in use or simply to provide a desired weight resistance.

Figures 1, 4:
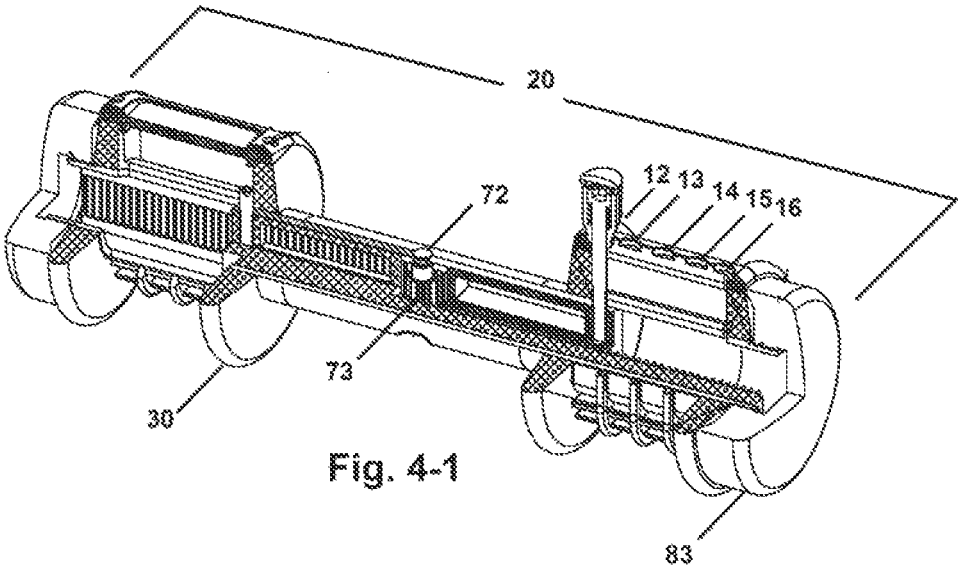
Figures 2, 4:
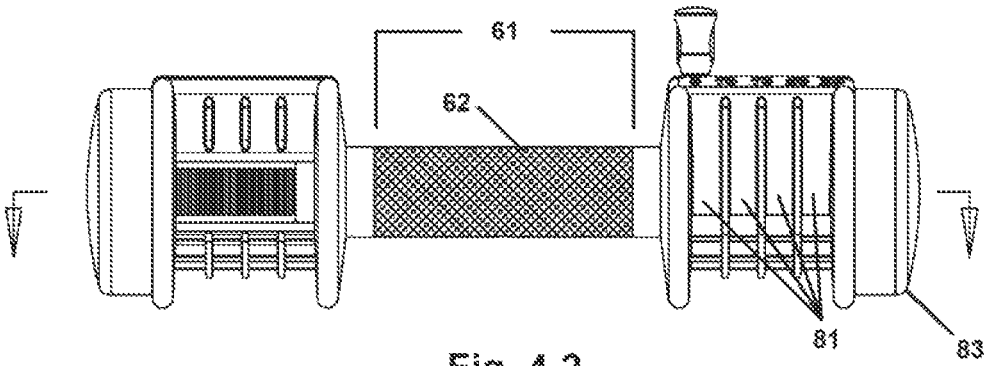
Figures 3, 4:
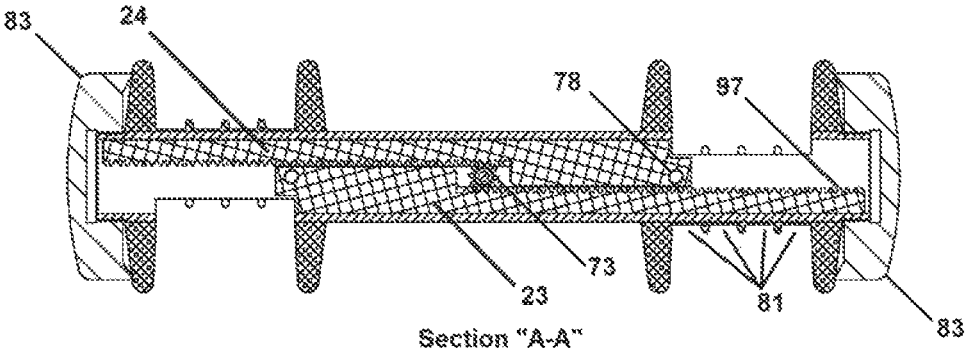
Figures 1, 6:
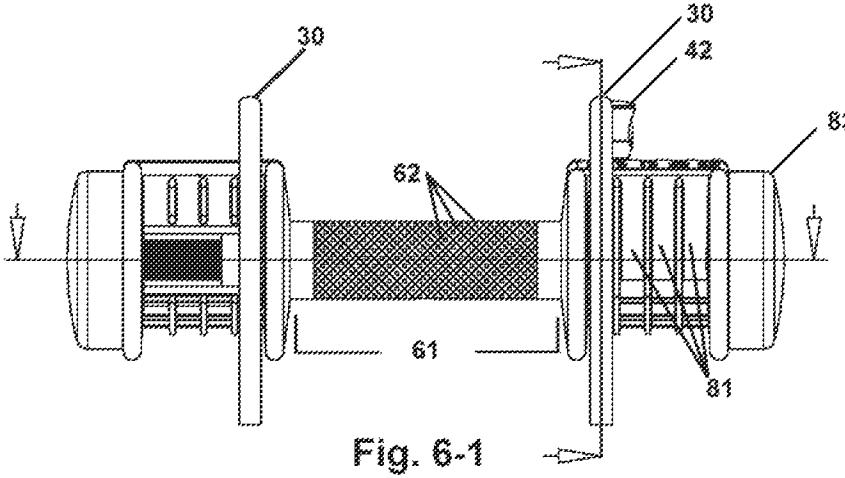
Figures 2, 6:
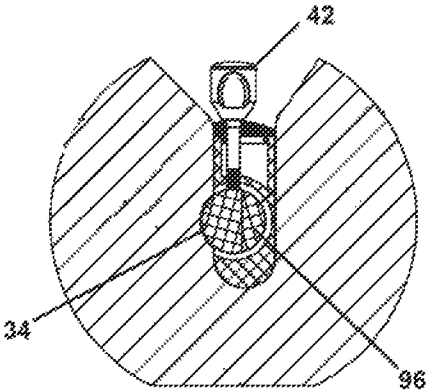
Figures 3, 6:
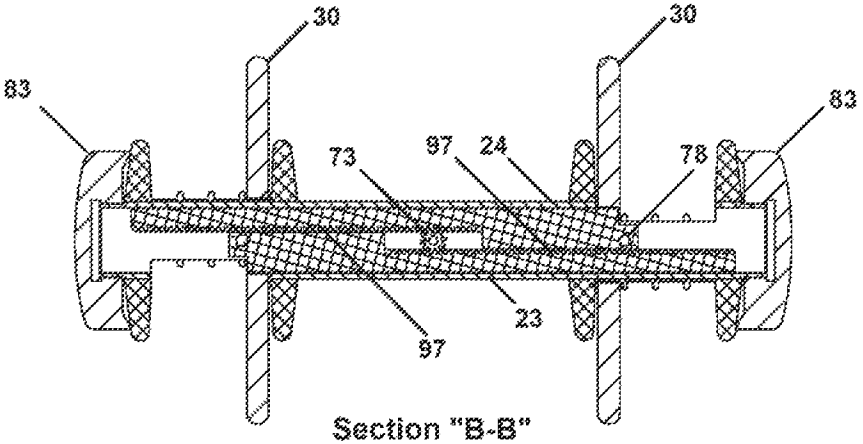
Figures 2, 7:
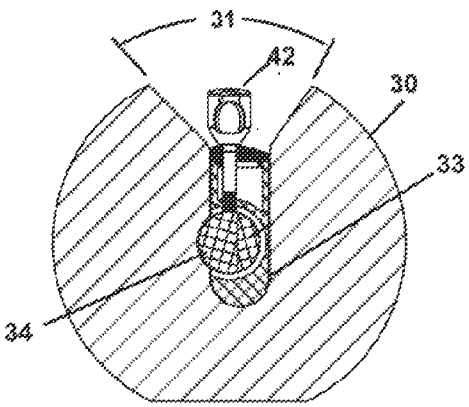
Figures 1, 7:
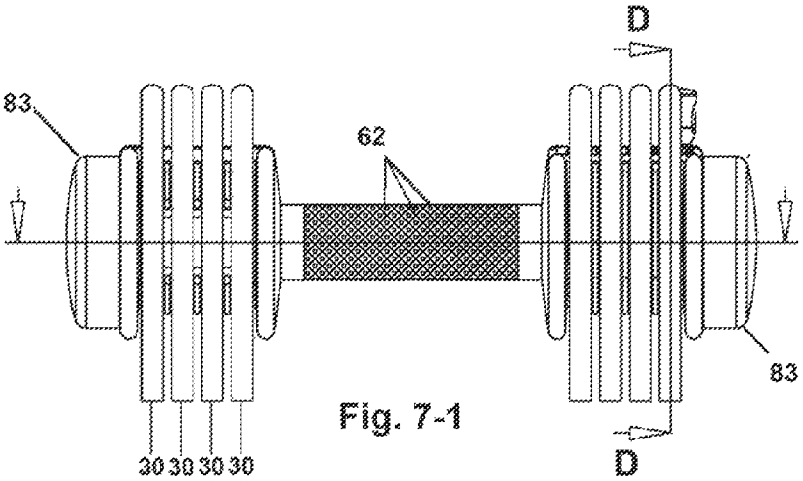
Figures 3, 7:
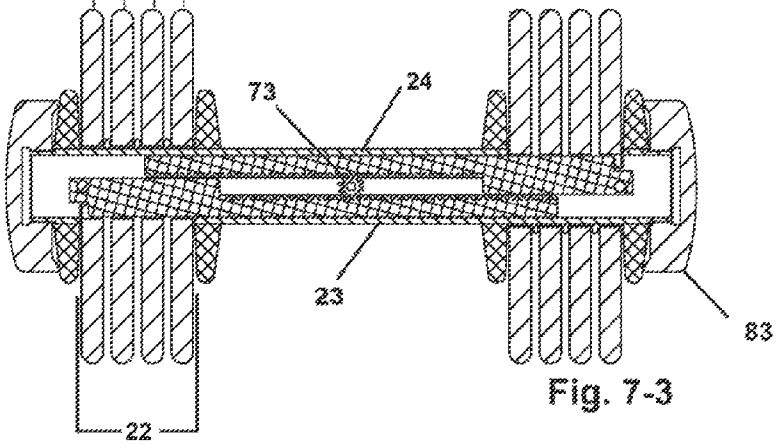

The handle member (21) is further adapted with a hole (71) which may receive an axle pin (72) which further may serve as the axle to a positioning gear (73). The positioning gear (73) through the hole (71) is fixed in the handle member (21) by an axle pin (72). Spline bolts bodies (23, 24) are inserted at both ends of the handle member (21) and engage with each other by means of the positioning gear (73). There is a threaded hole (78) in one end of the adjusting spline bolt body (24). After the adjusting spline bolt body (24) is inserted into handle member (21) totally, the positioning pin (27) will locate in the threading hole (78) of the adjusting spline bolt body (24) through the slide slot of handle bracket (22) and adjusting slot (17) (see FIG. 4) of handle member (26 21), thus limiting the moving of spline bolt body (24) to the functioned scope.

Cover plate (25) is fixed on handle bracket (20) by screw (28). The positioning plate (26) is fixed on the handle bracket (20) by positioning pin (27). The adjusting pin (29) is fixed in the threading hole (78) of spline bolt body (24) by the positioning base (81), fixing spring (49), positioning plate (26), slide slot and adjusting slot (17) (see FIG. 4) The handle cover (FIG. 5-4) fastens on positioning base (5-1). A weight body (83) is fixed on each end of the handle member (21) through threading (99).

The structures of the adjusting spline bolt body (24) and the adjusted spline bolt body (23) are crucial to the operation of this invention. They are identical except for the receiving threading hole (78) in the adjusting spline bolt body (24) which is adapted to receive the positioning screw portion (45) of the adjusting pin (29).

Lengths (91,92) of each spline bolt body (23,24) have a full circumference, moreover there are bulged portions (93, 94) of each full circumference lengths (91,92) which are adapted to slide within the arc slot (34) of each weight plate (30). This relationship will allow the simultaneous in and out movement of each spline body (23,24) to cause the bulged portions (93,94) of each of the full circumference lengths (91,92) of each spline member (23,24) to fit within the desired arc slot (34) of each weight plate (30) for lifting with the dumbbell (10).

Each spline bolt member (23,24) also has a cutaway lengths (95,96) with a half cutaway circumference. The bulged portions (93,94) of each cutaway circumference placed together fit snugly within the handle member (21). The cutaway lengths (95,96) are adapted with the meshed teeth (97) which are adapted to mechanically communicate with the positioning gear member (73) which is sandwiched between them. In this way, the inward or outward movement of the adjusting spline member (24) with the adjusting pin (29) will be matched by an equal and opposite inward or outward movement of the adjusting spline member (23).

In this manner, the bulged portions (93,94) of each spline member (23,24) will fit within the arc slots (34) of the desired weight plates (30), starting with the plates (30) positioned closest to the handle member (21) and cause them to be "selected" for use in a desired exercise.

It is now useful to describe how the user can simply and easily make the required adjustments. Such is done by means of the positioning base (50) and the positioning pin (27). Making reference to FIG. 5-1, it can be seen that one of the positioning plate (26) is adapted with a series of positioning holes (12) which are interconnected with a narrow channel (17).

The adjusting pin (29) attached to the adjusting spline member (23) is adapted to pass through this channel (17). As the adjusting pin (29) is moved from in to out, or vice versa, the above described interaction of the spline members (23,24) through the interior gear (73) cause the bulged portions (93-94) of each spline members (23, 24) to "select" the desired numbers of weight plates (30).

In order to facilitate the selections the free end (41) of the adjusting pin (29) is fitted with a retaining head (47) which will receive a spring loaded cap member (42). The spring loaded cap member further comprises an inverted cone member (43) which is, at its narrow end (44), adapted with a hole (45*a*) through which the adjusting pin (29) will snugly fit.

The adjusting pin (29) is adapted with an exterior threaded portion (45) which may be received by the interior threaded portion (46) (not shown) of adjusting spline number (24), a retaining head (47) on the other end of the adjusting pin (29), is of sufficient length to be threaded into the adjusting spline member (24) and through the channel (17) a sufficient distance to allow the 11 operation of a spring loaded cap member (42).

Accordingly, the adjusting pin (29) may be passed first through a coil spring (49), next through the cone member (43) wide end (48) first, next through the channel (17) and then its exterior threads (45) may be screwed into the interior threads (46) of the adjusting spline member (24).

The head (47) is of adequate diameter to hold the coil spring (49) so that it may provide tension as the cap member (42) is pulled up towards the head (47). The cap member (42) is also adapted to fit snugly with any desired one of the positioning holes (12-16). When the cap member (42) is pulled up, the adjusting pin (29) may be moved.

Each of the positioning holes (12-16) is adapted to move the spline members (23,24) to select a desired member of weight plates. The tensions of the coil spring (49) will cause the adjusting spline member (24) to remain locked in the desired positions to "select" the correct number of weight plates (30).

It should be noted that the scored gripping surface (62) could be eliminated or enhanced by providing some other gripping surface, such as rubber, plastic, vinyl, cloth, wool, or synthetic fabric. Such substitution could have the effect of making the apparatus easier and more comfortable to use although it would make the manufacture slightly more difficult. The point here is that it is quite possible that there are variations to the preferred embodiment which might provide one or more additional features to the apparatus which are still in keeping with the spirit and scope of the present invention.

It should also be noted that the spline members (23, 24) have been described as generally cylindrical in structure along their length and that the bulging portions (93,94) have been referred to as arced so that they may fit in the arc slot (34) of the weight plate delegated and rectangular slot (33). It is also possible that the spline members could be made with another cross-sectional shape, such as an oblong or polygon as long as such cross-sectional shape would permit the application of such features as the snug fit within the handle member (21), a bolting surface to fit within the arc slot (34) of the weight plate rectangular slot (33) and the provision of a flat surface with teeth along the flat surface of the cutaway portions (95, 964) of each spline member (23, 24). It is possible that selection of such a cross-sectional shape would facilitate easier manufacture without sacrificing the user-friendly quality of the apparatus.

It should further be noted that the bulging portions(93, 94) need not be arced and that the arc slot (34) of the rectangular slot (33) could be replaced with a widget shape, a square shape, or any other geometric configuration which would permit secure geometric communication between such bulging surface and the receiving portion of the rectangular and delegated slot on each weight plate.

Further modification and variation can be made to the disclosed embodiments without departing from the subject and spirit of the invention as defined in the following claims. All such modifications and variations, as included within the scope of these claims, are meant to be considered part of the invention as described.

What is claimed is:

1. A dumbbell apparatus which allows simple and accurate selection of a desired number of weight plates, the apparatus comprising:

a handle member;

a base member for positioning an equal number of weight plates on either side of said handle member, said base member comprises a handle bracket;

two adjusting spline members oppositely disposed, said weight plates being further adapted to receive a full circumference portion of each adjusting spline member which extends out from said handle member and passes through an arced slot of each of said weight plates;

each adjusting spline member comprising a bulging portion along the full circumference portion of the adjusting spline member, an interior cutaway portion configured with meshed teeth, and an interior threaded portion, said mesh teeth of the interior cutaway portion is configured to receive teeth of a threaded positioning gear;

said threaded positioning gear being mounted within and near a center of said handle member, said handle member being adapted to snugly and oppositely house said interior cutaway portion of said adjusting spline member so as to keep said interior cutaway portion of said adjusting spline member in mechanical communication with the other interior cutaway portion of the other adjusting spline member through said threaded positioning gear;

the bulging portion of each said full circumference portion of each said adjusting spline member being adapted to snugly fit through the arced slot of each said weight plate as it is cradled by said base member;

an adjusting means comprising an adjusting plate mounted on one end of said handle member, the adjusting plate comprising a series of adjusting holes positioned along a length of the adjusting plate which are separated by equal distances and joined by a narrow channel of sufficient width to permit an adjusting pin to slide back and forth through said narrow channel through each said adjusting holes from one end to another;

said adjusting pin is configured at one end, with exterior threads to be received by the interior thread portion of said adjusting spline member, and configured at an opposite end with a spring loaded cap which is adapted to fit snugly into a desired adjusting hole, each said adjusting hole being separated by a distance wherein the movement of the two adjusting spline members together, transmitted through the positioning gear, causes the bulging portion of each full circumference of each adjusting spline member to either slide into or out of the arced slot of said weight plates on each side of said handle member.

2. The dumbbell apparatus described in claim 1 in which the adjusting plate may be marked with a value for the weight associated with each adjusting hole.

3. The dumbbell apparatus described in claim 2 in which a gripping portion of said handle member is created by scoring said gripping portion exterior surface.

4. The dumbbell apparatus described in claim 3 in which the adjusting spline members are made with oblong cross-sectional members.

5. The dumbbell apparatus described in claim 1 in which a gripping portion of said handle member is created by scoring said gripping portion exterior surface.

6. The dumbbell apparatus described in claim 5 in which the adjusting spline members are made with oblong cross-sectional members.

7. The dumbbell apparatus described in claim 1 in which a gripping portion of said handle member is enhanced for use by applying a coating of rubber, vinyl, plastic, cloth, wool, or artificial fabric.

8. The dumbbell apparatus described in claim 7 in which the adjusting spline members are made with oblong cross-sectional members.

9. The dumbbell apparatus described in claim 2 in which a gripping portion of said handle member is enhanced for use by applying a coating of rubber, vinyl, plastic, cloth, wool, or artificial fabric.

10. The dumbbell apparatus described in claim 6 in which the adjusting spline members are made with oblong cross-sectional members.

11. The dumbbell apparatus described in claim 1 in which the adjusting spline members are made with oblong cross-sectional members.

12. The dumbbell apparatus described in claim 2 in which the adjusting spline members are made with oblong cross-sectional members.

13. The dumbbell apparatus described in claim 1 in which each handle member is adapted with weight members on an end of said handle bracket.

14. The dumbbell apparatus described in claim 2 in which each handle member is adapted with weight members on an end of said handle bracket.

* * * * *